US008177224B2

(12) United States Patent
Supron et al.

(10) Patent No.: US 8,177,224 B2
(45) Date of Patent: May 15, 2012

(54) METHODS AND APPARATUS FOR SHINGLE STACKING OF TICKETS IN A TICKET PRINTER

(75) Inventors: Steven A. Supron, Ithaca, NY (US); Bruce Harris, Freeville, NY (US)

(73) Assignee: TransAct Technologies Incorporated, Hamden, CT (US)

( * ) Notice: Subject to any disclaimer, the term of this patent is extended or adjusted under 35 U.S.C. 154(b) by 246 days.

(21) Appl. No.: 12/653,624

(22) Filed: Dec. 15, 2009

(65) Prior Publication Data

US 2011/0140338 A1 Jun. 16, 2011

(51) Int. Cl.
*B65H 43/00* (2006.01)

(52) U.S. Cl. ..... 271/176; 271/314

(58) Field of Classification Search ..... 271/176, 271/199, 314

See application file for complete search history.

(56) References Cited

U.S. PATENT DOCUMENTS

| | | | | |
|---|---|---|---|---|
| 4,660,053 | A | 4/1987 | Tsutsumi et al. | |
| 4,761,087 | A | 8/1988 | Ward et al. | |
| 5,041,845 | A | 8/1991 | Ohkubo et al. | |
| 5,083,880 | A | 1/1992 | Inomata et al. | |
| 5,158,381 | A | 10/1992 | Inomata et al. | |
| 5,158,642 | A * | 10/1992 | Koike | 156/767 |
| 5,223,940 | A | 6/1993 | Matsumoto | |
| 5,332,210 | A | 7/1994 | Silverberg et al. | |
| 5,413,426 | A | 5/1995 | Ijuin et al. | |
| 5,464,317 | A | 11/1995 | Foster et al. | |
| 5,482,389 | A | 1/1996 | Bickoff et al. | |
| 5,553,954 | A | 9/1996 | Nakano | |
| 5,624,196 | A | 4/1997 | Jackson et al. | |
| 5,671,065 | A | 9/1997 | Lee | |
| 5,743,663 | A | 4/1998 | Imai | |
| 5,772,343 | A | 6/1998 | Beretta et al. | |
| 5,887,868 | A | 3/1999 | Lambert et al. | |
| 6,234,696 | B1 | 5/2001 | Whittaker | |
| 6,290,410 | B1 | 9/2001 | Sunada et al. | |
| 6,305,856 | B1 | 10/2001 | Miyazaki | |
| 6,341,861 | B1 | 1/2002 | Sasaki | |
| 6,435,679 | B1 | 8/2002 | Weeks | |
| 6,447,186 | B1 | 9/2002 | Oguchi et al. | |
| 6,478,490 | B2 | 11/2002 | Kelley et al. | |
| 6,520,701 | B2 | 2/2003 | Kaya | |
| 6,652,173 | B1 * | 11/2003 | Martini et al. | 400/621 |
| 6,684,743 | B1 | 2/2004 | Brewington et al. | |

(Continued)

FOREIGN PATENT DOCUMENTS

| | | |
|---|---|---|
| EP | 0 721 827 | 7/1996 |

(Continued)

*Primary Examiner* — Michael McCullough

(74) *Attorney, Agent, or Firm* — Lipsitz & McAllister, LLC

(57) ABSTRACT

To ensure a proper stacking order of paper tickets that exit a transaction-based printer, a stacking nip is provided which accepts a first ticket. The first ticket is fed into the stacking nip, and then advanced by the stacking nip for a fixed distance until a trailing edge of the first ticket is positioned before the stacking nip. A second ticket is then fed towards the stacking nip. The first ticket is held in the stacking nip with the trailing edge positioned before the stacking nip until a leading edge of the second ticket overlaps the trailing edge of the first ticket. The trailing edge of the first ticket and the leading edge of the second ticket are then simultaneously advanced through the stacking nip. The first ticket is ejected from the stacking nip into a ticket bin once the trailing edge is advanced through the stacking nip.

18 Claims, 4 Drawing Sheets

U.S. PATENT DOCUMENTS

| | | | | |
|---|---|---|---|---|
| 6,827,515 | B2 | 12/2004 | Harris et al. | |
| 6,929,416 | B2 | 8/2005 | Harris et al. | |
| 7,275,883 | B2 | 10/2007 | Harris et al. | |
| 2006/0237900 | A1 * | 10/2006 | Sekiyama et al. | 271/220 |

FOREIGN PATENT DOCUMENTS

| | | |
|---|---|---|
| JP | 3071392 | 3/1991 |
| JP | 4067965 | 3/1992 |
| JP | 2004202611 | 7/2004 |
| JP | 2004291603 | 10/2004 |

* cited by examiner

METHODS AND APPARATUS FOR SHINGLE STACKING OF TICKETS IN A TICKET PRINTER

BACKGROUND OF THE INVENTION

The present invention relates to methods and apparatus for stacking paper tickets, receipts, vouchers and the like that exit a transaction-based printer. The tickets are fed into a ticket bin in an overlapped manner, which assures proper stacking and ordering of the printed tickets.

BACKGROUND OF THE INVENTION

High speed printers, such as inkjet, thermal, dye sublimation and dot matrix printers are used to provide vouchers, coupons, tickets, receipts and the like (all generally referred to herein as "tickets") to consumers. For example, when a winning lottery prize becomes relatively large, the lines at ticket sales counters become long. In addition, the number of tickets purchased by each person in the line can be relatively large. Most point of sales (POS) and other transaction-based printers have been designed to issue one ticket, voucher, coupon or receipt at a time. Sales personnel are therefore required to remove each printed sheet manually from the printer. When a number of lottery or wagering tickets, for example, are purchased in a single transaction, the sales person must compile all of the tickets for that transaction by hand. This can be a time consuming procedure leading to errors being made and long delays in ticket sales.

In printers that are able to issue more than one ticket at a time, problems develop due to the commonly used roll-type paper stock used in such printers, which causes the cut tickets to curl upon being ejected from the printer. A curled ticket may block the printer's ticket exit, such that subsequent tickets may be stacked out of order or pushed out of the ticket bin.

It would be advantageous to provide methods and apparatus for stacking multiple tickets which assures a proper stacking order. Such a stacking function would be particularly advantageous for high speed printers that dispense quantities of tickets, vouchers, receipts, coupons and other printed substrates. Such printers are often used in wagering and lottery terminals, as well as in other point of sale terminals such as those used to print train tickets, bus tickets, movie and theater tickets, retail coupons, and other substrates of value.

The present invention provides methods and apparatus for stacking tickets in a printer having the aforementioned and other advantages.

SUMMARY OF THE INVENTION

The present invention relates to methods and apparatus for stacking paper tickets, receipts, vouchers and the like that exit a transaction-based printer. The tickets are fed into a ticket bin in an overlapped manner, which assures proper stacking and ordering of the printed tickets.

In one example embodiment of a method for stacking tickets in a printer in accordance with the present invention, a stacking nip is provided which is adapted to accept a first ticket from a ticket cutter. The first ticket is fed into the stacking nip, and then advanced by the stacking nip for a fixed distance until a trailing edge of the first ticket is positioned before the stacking nip. A second ticket is then fed towards the stacking nip. The first ticket is held in the stacking nip with the trailing edge positioned before the stacking nip until a leading edge of the second ticket overlaps the trailing edge of the first ticket. The trailing edge of the first ticket and the leading edge of the second ticket are then simultaneously advanced through the stacking nip. The first ticket is ejected from the stacking nip into a ticket bin once the trailing edge is advanced through the stacking nip.

Once the first ticket is ejected, the stacking nip advances the second ticket by the fixed distance until a trailing edge of the second ticket is positioned before the stacking nip, and the process is repeated with subsequent tickets.

In one example embodiment, the stacking nip may be offset from the ticket cutter in a direction of travel of the ticket. For example, if the stacking nip is arranged vertically above the ticket cutter in the printer, the stacking nip may be horizontally offset from the ticket cutter.

A shelf may be provided between the ticket cutter and the stacking nip. The shelf may be offset from the ticket cutter. The shelf may be adapted to provide a space for the trailing edge of the first ticket to snap into when the stacking nip advances the first ticket the fixed distance. A guide may be provided leading from the ticket cutter to the stacking nip for guiding tickets from the ticket cutter past the shelf.

The overlap between the trailing edge of the first ticket and the leading edge of the second ticket may comprise approximately 0.125 inches.

A deflector may be provided to guide ejected tickets into a stacking position in the ticket bin and to support the ejected tickets in the stacking position in the ticket bin. The deflector may comprise a weighted pivoting deflector.

In a further example embodiment, the stacking nip may comprise two spaced apart pairs of rollers. Each pair of rollers may comprise a drive roller and an idler roller adapted to idle against the drive roller. A stacking shelf may be disposed in the ticket bin which extends in part between the two spaced apart pairs of rollers. Upon the ejecting of the first ticket, the trailing edge of the first ticket may rest on or above the stacking shelf. The first ticket may then be driven into a stacking position in the ticket bin. The weighted pivoting deflector may guide the ejected tickets into the stacking position in the ticket bin.

A ticket stacker for a printer is also provided in accordance with the present invention. In one example embodiment, the ticket stacker comprises a stacking nip adapted to accept tickets from a ticket cutter, drive means for feeding the tickets into the stacking nip, a stacker motor for driving the stacking nip which is adapted to partially mimic operation of the drive means, and a ticket bin for accepting the tickets ejected from the stacking nip. A first ticket is advanced by the stacking nip for a fixed distance until a trailing edge of the first ticket is positioned before the stacking nip. A second ticket is fed towards the stacking nip by the drive means. The first ticket is held in the stacking nip with the trailing edge positioned before the stacking nip until a leading edge of the second ticket overlaps the trailing edge of the first ticket. The trailing edge of the first ticket and the leading edge of the second ticket are simultaneously advanced through the stacking nip. The first ticket is ejected into the ticket bin once the trailing edge is advanced through the stacking nip.

The ticket stacker may also include additional features discussed above in connection with the various method embodiments.

BRIEF DESCRIPTION OF THE DRAWINGS

The present invention will hereinafter be described in conjunction with the appended drawing figures, wherein like reference numerals denote like elements, and.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

The present invention relates to methods and apparatus for stacking tickets in a ticket printer, where the tickets are fed into a ticket bin in an overlapped manner, which assures proper stacking and ordering of the printed tickets. It should be appreciated that the term "ticket" as used herein encompasses not only tickets (e.g., lottery tickets, etc.) but also any similar type of document, including vouchers, coupons, receipts and the like.

Figure 1:
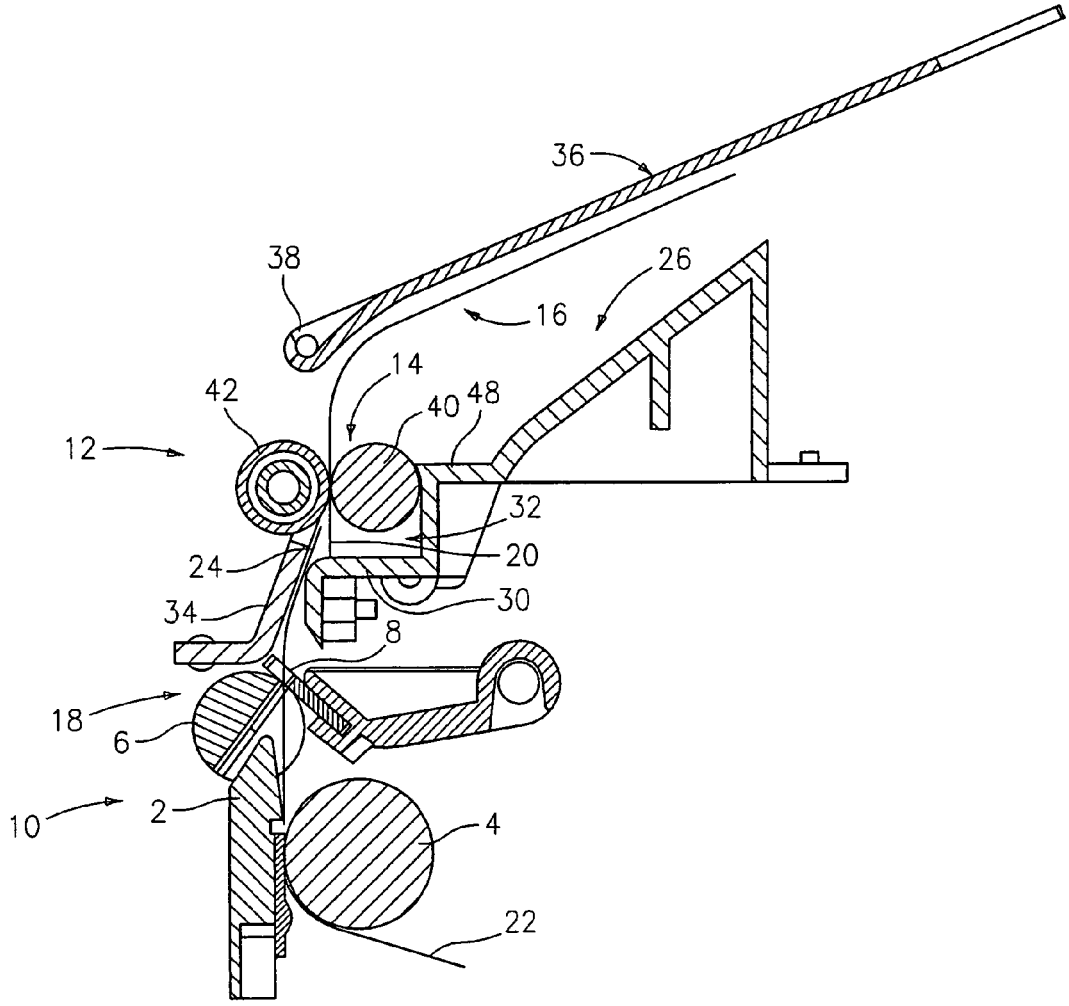
FIG. 1 shows an example embodiment of an apparatus in accordance with the present invention with tickets in an overlap position.
Figure 2:
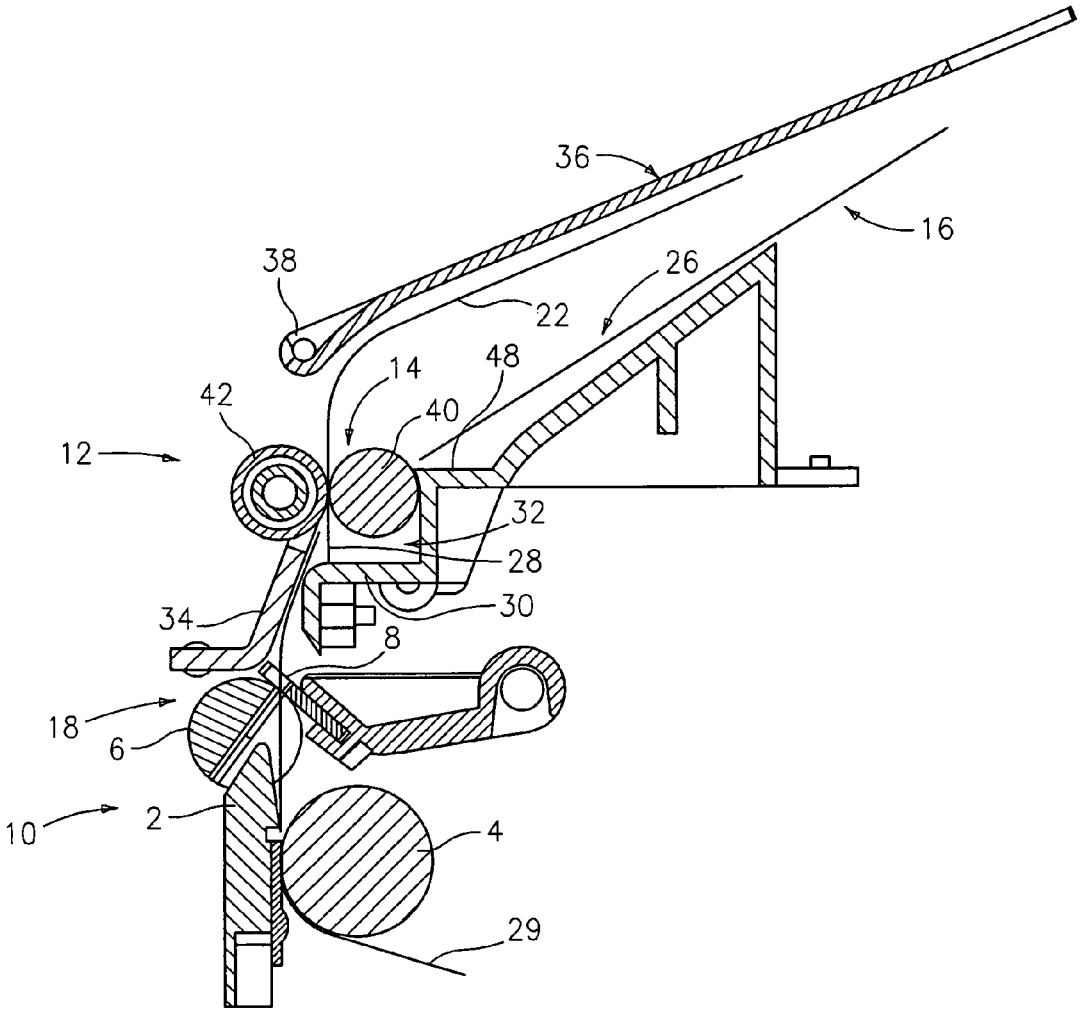
FIG. 2 shows an example embodiment of an apparatus in accordance with an example embodiment of the present invention with tickets in an overlap position and a ticket in the ticket bin.

FIGS. 1 and 2 show a portion of a printer in accordance with one example embodiment of the present invention, including a printing mechanism 10 and a stacking mechanism 12. The printing mechanism 10 includes a print head 2, a platen 4, and cutter 18 comprising a rotary knife 6, and a fixed blade 8. Portions of the printer which are not relevant to the explanation of the present invention are omitted for clarity and would be apparent to those skilled in the art. A stacking nip 14 is provided which is adapted to accept a first ticket 16 from a ticket cutter 18. As shown in FIG. 1, the first ticket 16 is fed into the stacking nip 14, and then advanced by the stacking nip 14 for a fixed distance until a trailing edge 20 of the first ticket 14 is positioned before the stacking nip 14. A second ticket 22 is then fed towards the stacking nip 14. The first ticket 16 is held in the stacking nip 14 with the trailing edge 20 positioned before the stacking nip 14 until a leading edge 24 of the second ticket 22 overlaps the trailing edge 20 of the first ticket 16. The trailing edge 20 of the first ticket 16 and the leading edge 24 of the second ticket 22 are then simultaneously advanced through the stacking nip 14. The first ticket 16 is ejected from the stacking nip 14 into a ticket bin 26 once the trailing edge 20 is advanced through the stacking nip 14. FIG. 2 shows the ejected first ticket 16 in a stacking position in the ticket bin 26.

As shown in FIG. 2, once the first ticket 16 is ejected, the stacking nip 14 advances the second ticket 22 by the fixed distance until a trailing edge 28 of the second ticket 24 is positioned before the stacking nip 14, and the process is repeated with subsequent tickets (e.g., a third ticket 29).

For ease of explanation, the drawings show the tickets as being of the same length. However, it should be appreciated that the present invention is adapted to print and stack tickets of varying lengths, so that the first ticket and the second ticket may be of different lengths, or different batches of tickets may have tickets of different lengths. Further, in the event that only one ticket is being printed, it will be advanced through the stacking nip and into the ticket bin without being stopped in the stacking nip, as only when multiple tickets are printed simultaneously is it necessary to provide an overlap of the leading and trailing edges of the current (e.g., first) and next (e.g., second) tickets to ensure proper stacking order.

In one example embodiment, the stacking nip 14 may be offset from the ticket cutter 18 in a direction of travel of the ticket. For example, if the stacking nip 14 is arranged vertically above the ticket cutter 18 in the printer (as shown, for example, in FIGS. 1 and 2), the stacking nip 14 may be horizontally offset from the ticket cutter 18 as shown.

A shelf 30 may be provided between the ticket cutter 18 and the stacking nip 14. The shelf 30 may offset from the ticket cutter 18. The shelf may be adapted to provide a space 32 for the trailing edge 20 of the first ticket 16 to snap into when the stacking nip 14 advances the first ticket 16 the fixed distance. In addition, a guide 34 may be provided leading from the ticket cutter 18 to the stacking nip 14 for guiding tickets from the ticket cutter 18, past the shelf 30, and into the stacking nip 14. For example, the guide 34 may act as a guide to lead the leading edge of the ticket 16 to the stacking nip 14, which is offset from the ticket cutter 18. The ticket 16 is then bent around the shelf 30 when advanced by the stacking nip 14. After the ticket 16 is advanced by the fixed distance, the trailing edge 20 of the ticket will snap into a position behind the shelf 30, as shown in FIG. 1. This ensures that leading edge of the next ticket (e.g., leading edge 24 of ticket 22), when advanced towards the stacking nip 14, can pass the trailing edge of the preceding ticket (e.g., trailing edge 20 of ticket 16) to create an overlap and thus assure a correct ticket stacking order.

The overlap between the trailing edge 20 of the first ticket 16 and the leading edge 24 of the second ticket 22 may comprise, for example, approximately 0.125 inches. However, a different amount of overlap may be provided as long as the amount of overlap ensures proper ordering of the tickets being fed through the stacking nip 14 and into the ticket bin 26.

A deflector 36 may be provided to guide ejected tickets into a stacking position in the ticket bin 26 and to support the ejected tickets in the stacking position in the ticket bin 26. The deflector 36 may comprise a weighted pivoting deflector. The deflector 36 may be secured to a cover or printer housing via a hinge or pivot point 38. The deflector 36 guides the tickets into the ticket bin 26 and may apply pressure to the stack of tickets in the ticket bin 26, to maintain the stack of tickets in the ticket bin 26 in an orderly manner in a correct sequence.

Figure 3:
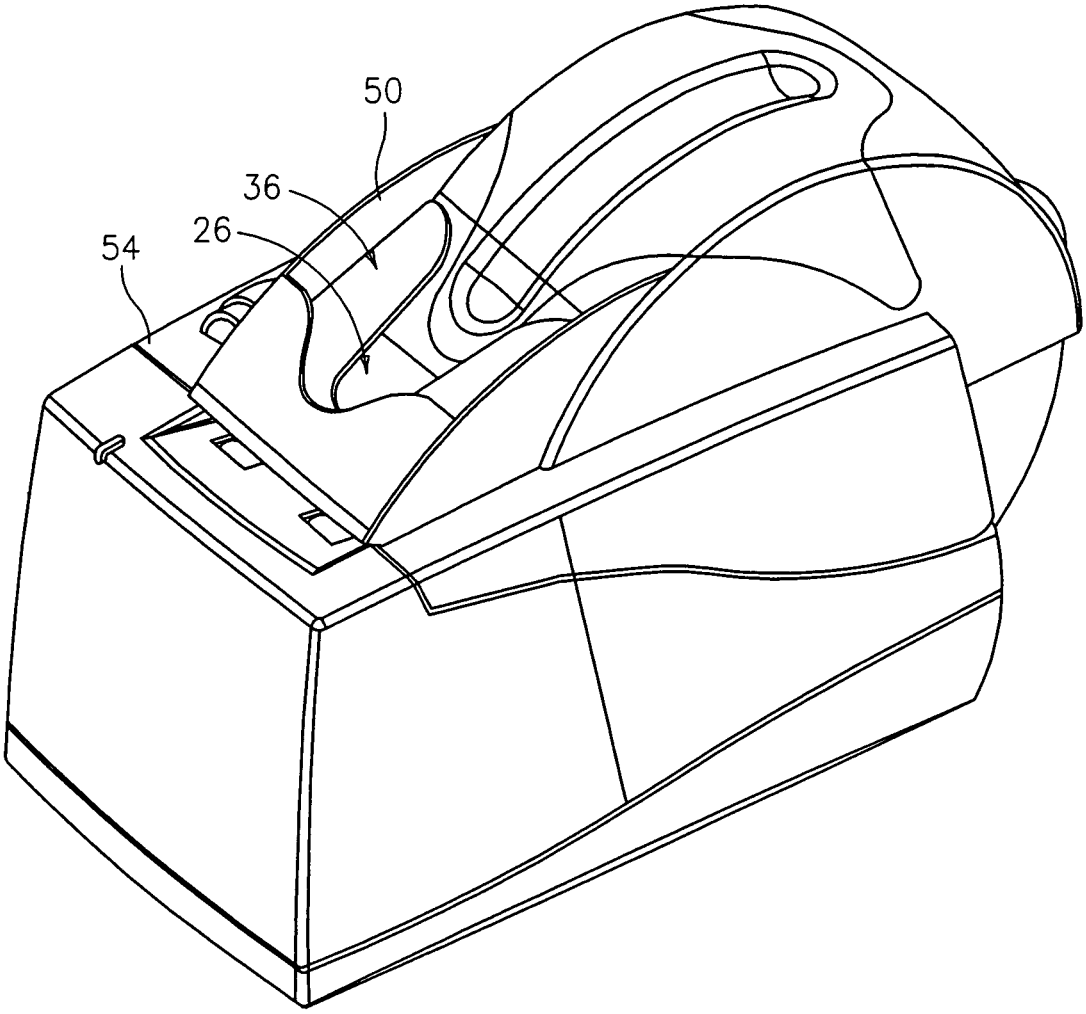
FIG. 3 shows an example embodiment of a printer in accordance with the present invention.

FIG. 3 shows an example embodiment of a printer with a stacking mechanism in accordance with the present invention. As can be seen from FIG. 3, the ticket bin 26 may be formed as part of a cover 50 for a paper roll 52 (shown in FIG. 4) of the printer. The deflector 26 may be secured to this cover 50 or to the printer housing 54 via the hinge or pivot 38.

Figure 4:
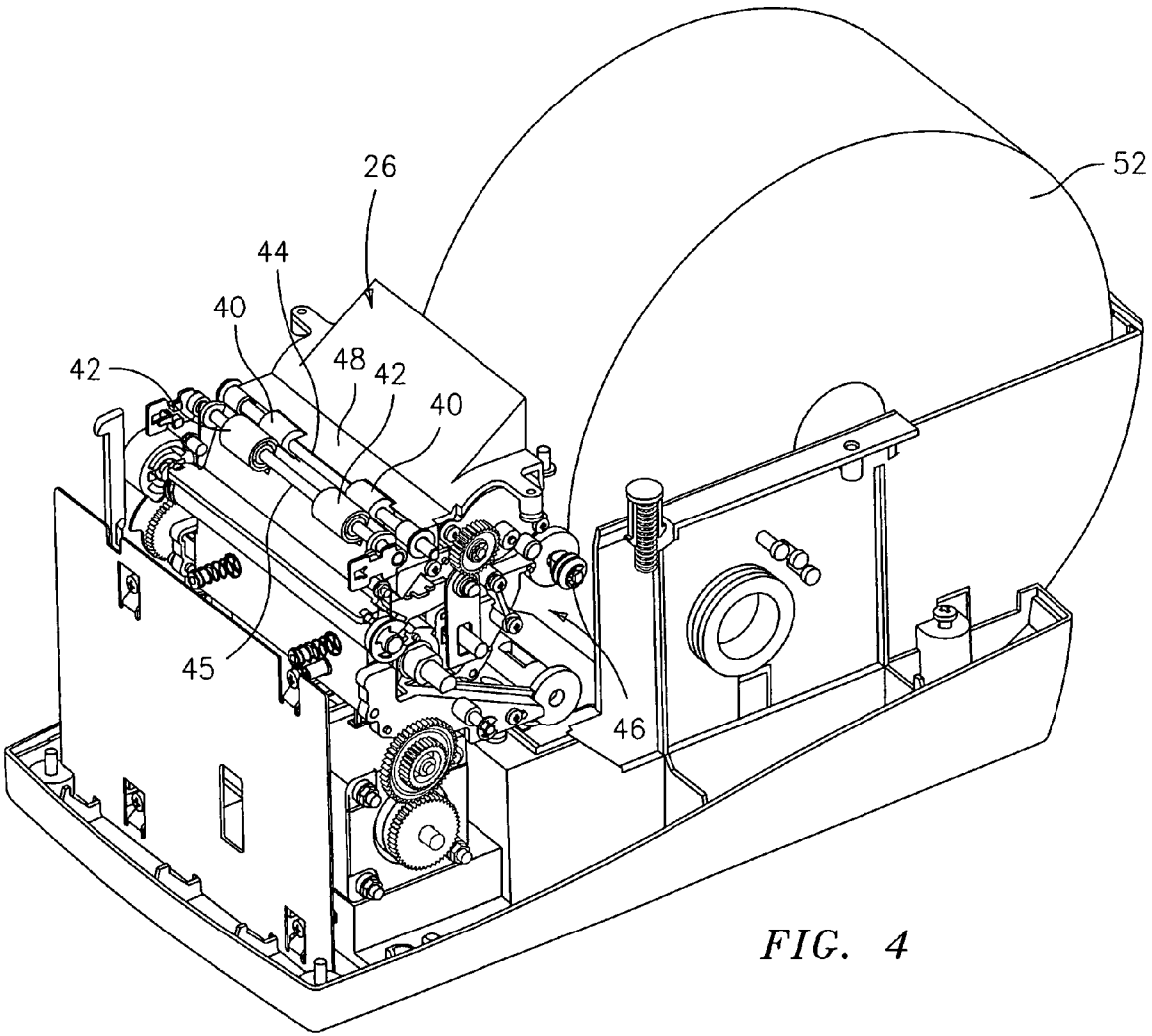
FIG. 4 shows an example embodiment of the stacking nip and stacking tray in accordance with an example embodiment of the present invention.

In a further example embodiment, the stacking nip 14 may comprise two spaced apart pairs of rollers. FIGS. 1 and 2 show a side view of one of the pairs of rollers that comprise the stacking nip 14. Each pair of rollers may comprise a drive roller 40 and an idler roller 42 adapted to idle against the drive roller 40. FIG. 4 shows the spaced apart pairs of rollers 40, 42. For example, the drive rollers may be spaced apart on a rod 44 driven by a drive mechanism 46 that includes gears and a motor as is known in the art. The idler rollers 42 may be spaced apart on a rod 45. A stacking shelf 48 may be disposed in the ticket bin 26 and this shelf 48 may extend in part between the two spaced apart pairs of rollers 40, 42. Upon the ejecting of the first ticket 16, the trailing edge 20 of the first ticket 16 may rest on or above the stacking shelf 48. The first ticket 16 may then be driven into a stacking position in the ticket bin 26. The weighted pivoting deflector 36 may guide the ejected tickets into the stacking position in the ticket bin 26.

Alternatively, upon the ejecting of the first ticket 16, the trailing edge 20 of the first ticket 16 may rest on a semi-circular portion (not shown) of the ticket bin 26 that closely conforms to a partial circumference of one of the idler rollers or the drive rollers. For example, the stacking shelf 48 may be extended to at least partially cover the drive rollers 40.

In a further example embodiment, the trailing edge of the first ticket may come to rest on one of the idler rollers or the drive rollers. The first ticket can then be driven behind the rollers into a stacking position in the ticket bin when the rollers advance. For example, the trailing edge 20 of the first ticket 16 may come to rest on drive rollers 40 when ejected from the stacking nip 14, and be driven into the ticket bin 26 when the roller 40 is advanced further. A further deflector (not shown) may be provided to ensure that the trailing edge 20 of the first ticket 16 maintains contact with the one roller upon the ejecting of the first ticket and that the ticket is guided into the stacking position.

In order to move the tickets through the printing mechanism 10 and into the stacker 12, the motor (not shown, part of drive mechanism 46) for the drive roller 40 of the stacking nip 14 is controlled to correspond closely to the platen drive 4. As the ticket is advanced through the print station 10 by the platen drive 4, the stacker motor drives the drive roller 40 of the stacking nip 14 by a corresponding amount at a corresponding rate. This amount/rate may be variable as the print speed may vary depending on the characteristics of the data being printed on different portions of the ticket. When the printing is finished, the platen drive 4 stops, as does the drive roller 40 of the stacker. The ticket is then cut from the roll of tickets by cutter 18 and the ticket is then advanced by a fixed distance until the trailing edge of the ticket is past the edge of the shelf 30 (the fixed distance corresponds to the distance between the cutter 18 and the shelf 30). The drive roller 40 is then stopped and does not advance until the platen drive 4 moves the fixed distance plus the desired overlap between the two tickets. Once this distance is reached, the stacker motor (and thus the stacking nip 14) then begins to mimic the movement and rate of the platen drive 4, driving the trailing edge of the current ticket (e.g., trailing edge 20 of first ticket 16) and the leading edge of the next ticket (e.g., leading edge 24 of the second ticket 22) through the stacking nip 14 until the current ticket is ejected into the ticket bin 26 and the next ticket has printed. Once cut, the next ticket is advanced by the stacking nip 40 by the fixed distance and the process is repeated with subsequent tickets.

Those skilled in the art will appreciate that although motor position control is used to advance the tickets the desired amount to achieve the desired positioning of the tickets, other methods may also be used, including methods using software control, sensor feedback, and the like.

It should now be appreciated that the present invention provides advantageous methods and apparatus for stacking tickets in a ticket printer.

Although the invention has been described in connection with various illustrated embodiments, numerous modifications and adaptations may be made thereto without departing from the spirit and scope of the invention as set forth in the claims.

What is claimed is:

1. Method for stacking tickets in a printer, comprising:

providing a stacking nip adapted to accept tickets from a ticket cutter, the stacking nip being offset from the ticket cutter in a direction of travel of the tickets;

feeding a first ticket into the stacking nip;

providing a shelf between the ticket cutter and the stacking nip, the shelf being offset from the ticket cutter;

advancing the first ticket by the stacking nip for a fixed distance until a trailing edge of the first ticket snaps into a space provided by the shelf and is positioned before the stacking nip;

feeding a second ticket towards the stacking nip;

holding the first ticket in the stacking nip with the trailing edge positioned before the stacking nip until a leading edge of the second ticket overlaps the trailing edge of the first ticket;

simultaneously advancing the trailing edge of the first ticket and the leading edge of the second ticket through the stacking nip;

ejecting the first ticket from the stacking nip into a ticket bin once the trailing edge is advanced through the stacking nip.

2. A method in accordance with claim 1, wherein the stacking nip advances the second ticket by said fixed distance until a trailing edge of the second ticket is positioned before the stacking nip.

3. A method in accordance with claim 1, further comprising:

providing a guide leading from the ticket cutter to the stacking nip for guiding tickets from the ticket cutter past the shelf.

4. A method in accordance with claim 1, wherein:

the stacking nip is arranged vertically above the ticket cutter; and the stacking nip is horizontally offset from the ticket cutter.

5. A method in accordance with claim 1, wherein the overlap between the trailing edge of the first ticket and the leading edge of the second ticket comprises approximately 0.125 inches.

6. A method in accordance with claim 1, wherein:

the stacking nip comprises two spaced apart pairs of rollers; and each pair of rollers comprises a drive roller and an idler roller adapted to idle against the drive roller.

7. A method in accordance with claim 6, further comprising:

a stacking shelf disposed in the ticket bin and extending in part between the two spaced apart pairs of rollers;

wherein, upon the ejecting of the first ticket, the trailing edge of the first ticket rests on or above the stacking shelf; and the first ticket is driven into a stacking position in the ticket bin.

8. A method in accordance with claim 7, wherein:

a weighted pivoting deflector is provided for guiding ejected tickets into the stacking position in the ticket bin.

9. A method in accordance with claim 1, further comprising:

providing a deflector to guide ejected tickets into a stacking position in the ticket bin and to support the ejected tickets in the stacking position in the ticket bin.

10. A ticket stacker for a printer, comprising:

a stacking nip adapted to accept tickets from a ticket cutter, the stacking nip being offset from the ticket cutter in a direction of travel of the tickets;

a shelf positioned between the ticket cutter and the stacking nip, the shelf being offset from the ticket cutter;

drive means for feeding the tickets into the stacking nip;

a stacker motor for driving the stacking nip;

a ticket bin for accepting the tickets ejected from the stacking nip;

wherein:

a first ticket is advanced by the stacking nip for a fixed distance until a trailing edge of the first ticket snaps into a space provided by the shelf and is positioned before the stacking nip;

a second ticket is fed towards the stacking nip by the drive means;

the first ticket is held in the stacking nip with the trailing edge positioned before the stacking nip until a leading edge of the second ticket overlaps the trailing edge of the first ticket;

the trailing edge of the first ticket and the leading edge of the second ticket are simultaneously advanced through the stacking nip;

the first ticket is ejected into the ticket bin once the trailing edge is advanced through the stacking nip.

11. A ticket stacker in accordance with claim 10, wherein the stacking nip advances the second ticket by said fixed distance until a trailing edge of the second ticket is positioned before the stacking nip.

12. A ticket stacker in accordance with claim 10, further comprising:

a guide leading from the ticket cutter to the stacking nip for guiding tickets from the ticket cutter past the shelf.

13. A ticket stacker in accordance with claim 10, wherein:

the stacking nip is arranged vertically above the ticket cutter; and the stacking nip is horizontally offset from the ticket cutter.

14. A ticket stacker in accordance with claim 10, wherein the overlap between the trailing edge of the first ticket and the leading edge of the second ticket comprises approximately 0.125 inches.

15. A ticket stacker in accordance with claim 10, wherein:

the stacking nip comprises two spaced apart pairs of rollers; and each pair of rollers comprises a drive roller and an idler roller adapted to idle against the drive roller.

16. A ticket stacker in accordance with claim 15, further comprising:

a stacking shelf disposed in the ticket bin and extending in part between the two spaced apart pairs of rollers; wherein:

upon the ejecting of the first ticket, the trailing edge of the first ticket rests on or above the stacking shelf; and the first ticket is driven into a stacking position in the ticket bin.

17. A ticket stacker in accordance with claim 16, further comprising:

a weighted pivoting deflector for guiding the ejected tickets into the stacking position in the ticket bin.

18. A ticket stacker in accordance with claim 10, further comprising:

a deflector to guide the ejected tickets into a stacking position in the ticket bin and to support the ejected tickets in the stacking position in the ticket bin.

* * * * *